United States Patent [19]

Goubeaux et al.

[11] Patent Number: 4,969,334

[45] Date of Patent: Nov. 13, 1990

[54] OVERSPEED PROTECTION METHOD FOR AN AUTOMOTIVE ENGINE DRIVEN AIR CONDITIONING COMPRESSOR

[75] Inventors: Ronald J. Goubeaux, Lockport; Joseph L. Spurney, Rochester, both of N.Y.

[73] Assignee: General Motors Corporation, Detroit, Mich.

[21] Appl. No.: 399,039

[22] Filed: Aug. 28, 1989

[51] Int. Cl.[5] ..... F04B 1/26; B60H 1/32

[52] U.S. Cl. ..... 62/133; 417/53; 417/222; 417/212

[58] Field of Search ..... 417/53, 212, 222, 222 S; 62/133

[56] References Cited

U.S. PATENT DOCUMENTS

| | | | |
|---|---|---|---|
| 4,796,438 | 1/1989 | Sato | 62/133 |
| 4,823,555 | 4/1989 | Ohkumo | 62/133 |
| 4,872,814 | 10/1989 | Skinner et al. | 417/222 S |
| 4,880,356 | 11/1989 | Suzuki et al. | 417/53 |

*Primary Examiner*—Leonard E. Smith

*Assistant Examiner*—David Scheuermann

*Attorney, Agent, or Firm*—Mark A. Navarre

[57] ABSTRACT

A control method for a variable capacity automotive engine driven air conditioning compressor in which the onset of an overspeed condition is anticipated in relation to the compressor speed and acceleration for the purpose of initiating an override of the normal control setting to quickly destroke the compressor so long as the overspeed condition is indicated. In normal operation, the control setting for the air conditioning system is chosen in relation to the current compressor speed. The compressor capacity is electrically controlled in relation to the error between the control setting and an actual or measured setting. Concurrently, a secondary control setting is determined based on an estimate of a future compressor speed, given the current rate of change in compressor speed. When the secondary control setting would produce more destroke than the primary control setting, the secondary control overrides the primary control to protect the compressor should the current conditions continue.

8 Claims, 5 Drawing Sheets

OVERSPEED PROTECTION METHOD FOR AN AUTOMOTIVE ENGINE DRIVEN AIR CONDITIONING COMPRESSOR

This invention pertains to the control of an automotive engine driven variable displacement air conditioning compressor, and more particularly, to a control method for protecting the compressor in the event of an overspeed condition.

BACKGROUND OF THE INVENTION

Variable displacement refrigerant compressors have been employed in engine driven automotive air conditioning systems in order to reduce engine load variations associated with compressor cycling. Such compressors typically cannot withstand sustained high speed operation without destroking to minimum displacement. As an engine driven accessory, however, the compressor speed is dependent on the engine speed, which can vary quite rapidly under various operating conditions.

In the past, high speed durability concerns have been addressed by declutching the compressor in response to the detection of potentially destructive compressor or engine speeds. Unfortunately, this requires the use of limits which are either specific to a particular installation or unduly conservative.

SUMMARY OF THE PRESENT INVENTION

The present invention is directed to an improved control method for a variable capacity automotive engine driven air conditioning compressor in which the onset of an overspeed condition is anticipated in relation to the compressor speed and acceleration for the purpose of initiating an override of the normal control setting to quickly destroke the compressor so long as the overspeed condition is indicated.

In normal operation, the primary control setting for the air conditioning system is chosen in relation to the current compressor speed. The compressor capacity is electrically controlled in relation to the error between the control setting and an actual or measured setting. Concurrently, a secondary control setting is determined in relation to a forecasted compressor speed based on an extrapolation of the current compressor speed and acceleration, at least when such acceleration is positive. When the secondary control setting would produce more destroke than the primary control setting, the secondary control overrides the primary control to protect the compressor should the current conditions continue.

With this control, destroking is only initiated when required to protect the compressor and the performance of the air conditioning system is not unduly compromised during transient operating conditions.

DETAILED DESCRIPTION OF THE INVENTION

Figure 1:
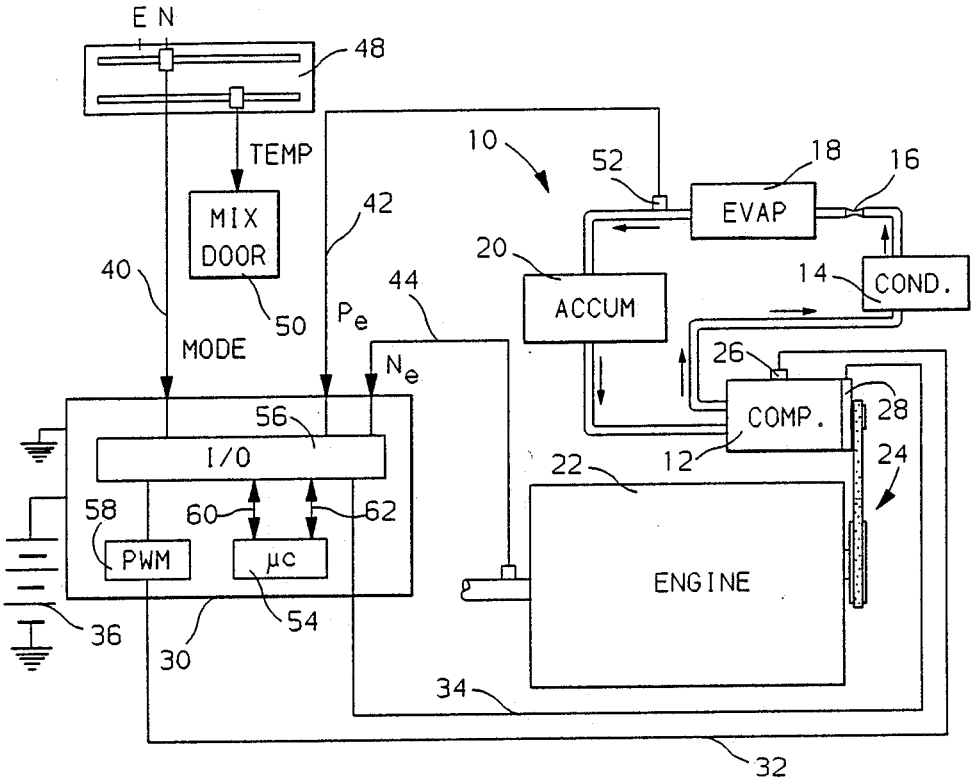
FIG. 1 is a block diagram of an automotive air conditioning system in accordance with the present invention, including a computer-based electronic control unit.

Referring to FIG. 1, the reference numeral 10 generally designates an automotive air conditioning system including a variable displacement refrigerant compressor 12, a condenser core 14, an expansion orifice 16, an evaporator core 18 and an accumulator 20. The compressor 12 is driven by the vehicle engine 22 via a belt and pulley drive arrangement, generally designated by the reference numeral 24. For control purposes, the compressor 12 includes a pulse-width-modulated (PWM) transducer 26 for regulating the compressor displacement (and therefore its capacity) by controlling the pressure in its crankcase. At one travel limit of the transducer 26, the crankcase is opened to the compressor outlet; at the other travel limit, the crankcase is opened to the compressor inlet.

The duty cycle of PWM ratiometrically controls the crankcase pressure between the two extremes. An electronic control unit 30 controls the operation of the transducer 26 and clutch 28 via lines 32 and 34, as explained below. An electromagnetic clutch 28 is provided for selectively engaging and disengaging the pulley drive arrangement 24. An exemplary compressor and pneumatic transducer are described in detail in the U.S. Pat. to Skinner No. 4,428,718, issued Jan. 31, 1984, and assigned to the assignee of the present invention.

In operation, warm pressurized gaseous refrigerant discharged from the engine driven compressor 12 is cooled and liquefied by the condenser 14, which is typically air cooled. The orifice 16 rapidly decreases in the pressure of the condensed refrigerant, effecting further cooling of the same prior to its entry into the evaporator 18. In the evaporator 18, circulated warm air from the vehicle passenger compartment vaporizes or boils the cooled refrigerant, thereby cooling the return air. The warmed refrigerant is then discharged to the accumulator 20, which separates out the gaseous portion for return to the inlet of compressor 12.

The control unit 30 is powered by the vehicle storage battery 36, and generates control signals for the compressor 12 and clutch 28 on lines 32 and 34 in response to various input signals received on lines 40–44. The MODE signal on line 40 is obtained from an operator manipulated control head 48, by which the operator designates the desired operating mode: normal (N) or economy (E). The control head 48 also serves to position a mix door 50 for regulating the temperature of the conditioned air supplied to the passenger compartment. The pressure signal $P_e$ on line 42 is generated by a pressure transducer 52 mounted at the outlet of evaporator 18 to sense the pressure of the gaseous refrigerant therein. Finally, the speed signal $N_e$ on line 44 is generated by a speed transducer 54 responsive the rotary speed of the output shaft 56 of engine 22.

In operation, the control unit 30 uses the MODE and $N_e$ signals on lines 40 and 44 to develop a control setting, designated herein as a pressure command PCMD for the outlet of the evaporator 18. The pressure signal $P_e$ on line 42 is used as a feedback parameter and the transducer 26 is energized via line 32 at a duty cycle determined in relation to the difference (PCMD - $P_e$) between the commanded and actual pressure values.

Internally, the control unit 30 comprises a microcomputer (uC) 54, an Input/Output (I/0) device 56, a pulse-width-modulation (PWM) driver 58, an address and control bus 60 and a data bus 62. The I/0 device 56 receives the inputs on lines 38–44, and under the control of microcomputer 54, supplies a duty cycle command to the PWM driver 58. Flow diagrams representative of the program instructions executed by the microcomputer 54 are described below in reference to FIGS. 4–6.

Figure 2:
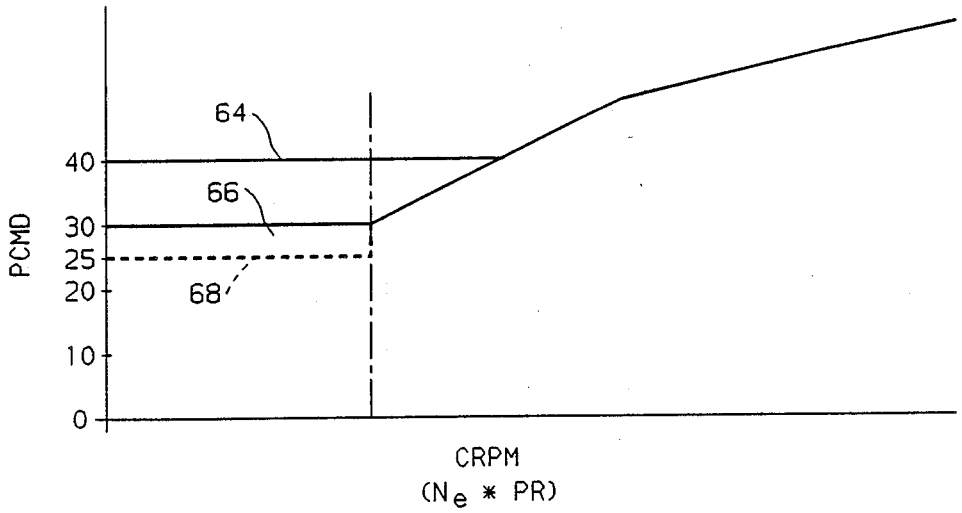
FIG. 2 is a graph depicting the system control setting as a function of the operating mode and compressor speed.

Referring to the graph of FIG. 2, the solid traces 64 and 66 depict representative pressure commands PCMD for the economy and normal modes. The broken trace 68 depicts a pulldown pressure command schedule which may be temporarily employed at the initiation of operation to effect rapid cooling of a hot passenger compartment. As indicated, the commanded pressure PCMD is determined as a function of both MODE and compressor speed (CRPM), the compressor speed being conveniently computed as the product ($N_e$ * PR) of engine speed $N_e$ and the speed ratio (PR) of the pulley drive arrangement 24. Significantly, the pressure commands converge with increasing compressor speed, reflecting the need to destroke the compressor 12 during relatively high speed operation.

According to the present invention, the pressure command PCMD is developed in accordance with the higher of first and second pressure commands, referred to herein as PCMDl and PCMD2. The first pressure command PCMDl is determined, as described in reference to FIG. 2, as a function of MODE and the current compressor speed CRPM. The second pressure command PCMD2, on the other hand, is determined as a function of an estimate or forecast of a future compressor speed. The forecasted compressor speed is determined by projecting the current speed and acceleration of the compressor 12 a predetermined time into the future. The predetermined time of the forecasted speed is related to the interval nominally required to destroke the compressor 12, about three seconds in the illustrated embodiment.

In a condition of rapid acceleration, the second pressure command will therefore exceed the first pressure command, and the controller 30 will initiate destroking of the compressor before an overspeed condition actually occurs. By relating the forecast interval to the time nominally required to destroke the compressor, the controller can adequately anticipate the overspeed condition. As a result, the compressor may be fully destroked if necessary by the time the overspeed condition actually occurs, avoiding needless disengagement of the clutch 28. Significantly, the second pressure command is continuously updated so only the required amount of destroke occurs and so that destroking is suspended as soon as the drive conditions no longer require it. In other words, the controller can ensure the safety of the compressor 12 in transient and high speed conditions without unduly degrading the performance of the air conditioning system 10. If dangerously high speeds are actually reached, or the controller is unable to destroke the compressor 12, the clutch 28 is disengaged until the condition is alleviated.

Figure 4:
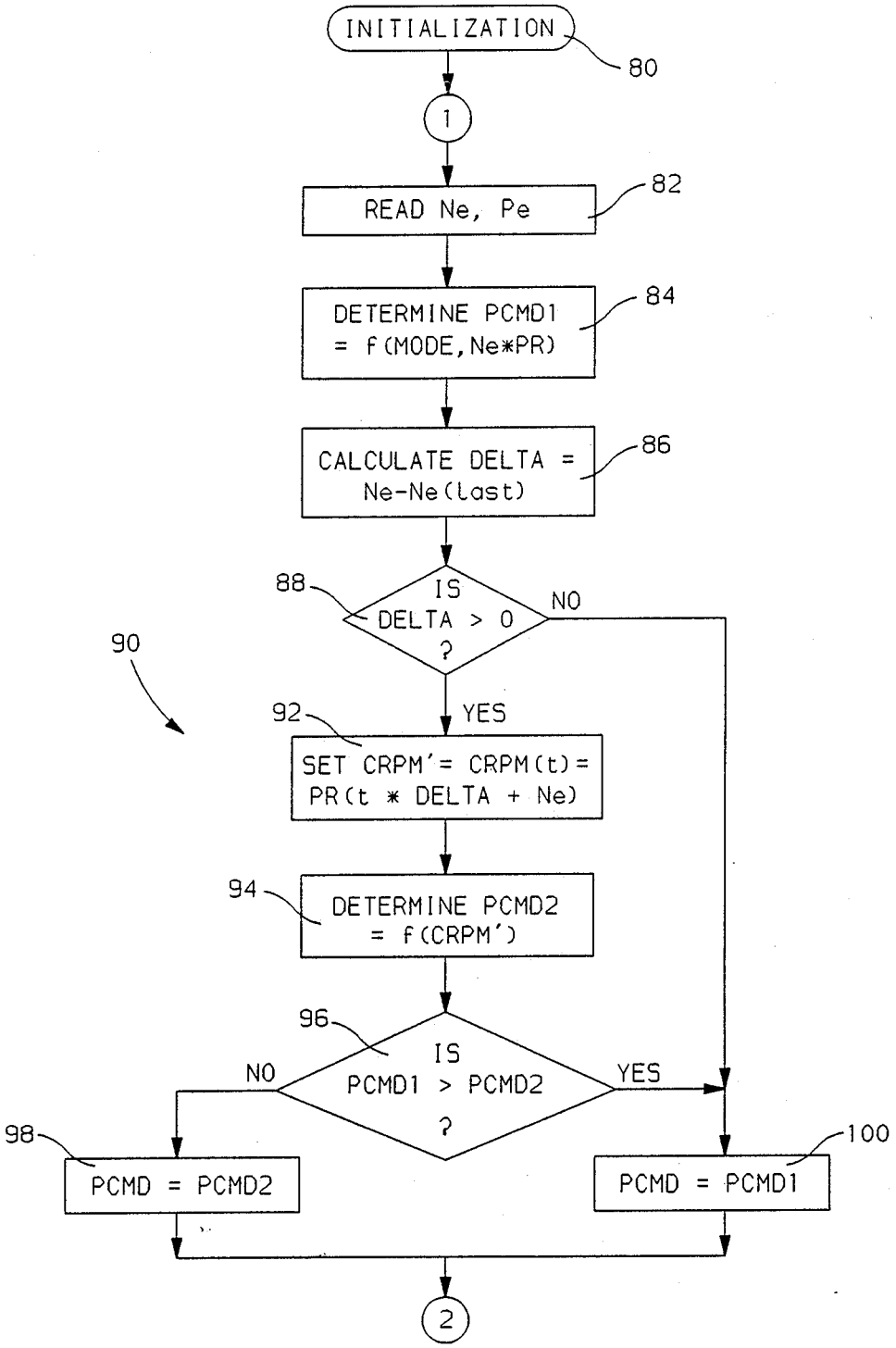
FIGS. 4–6 are flow diagrams depicting the functions performed by the computer-based control unit of FIG. 1.
Figure 5:
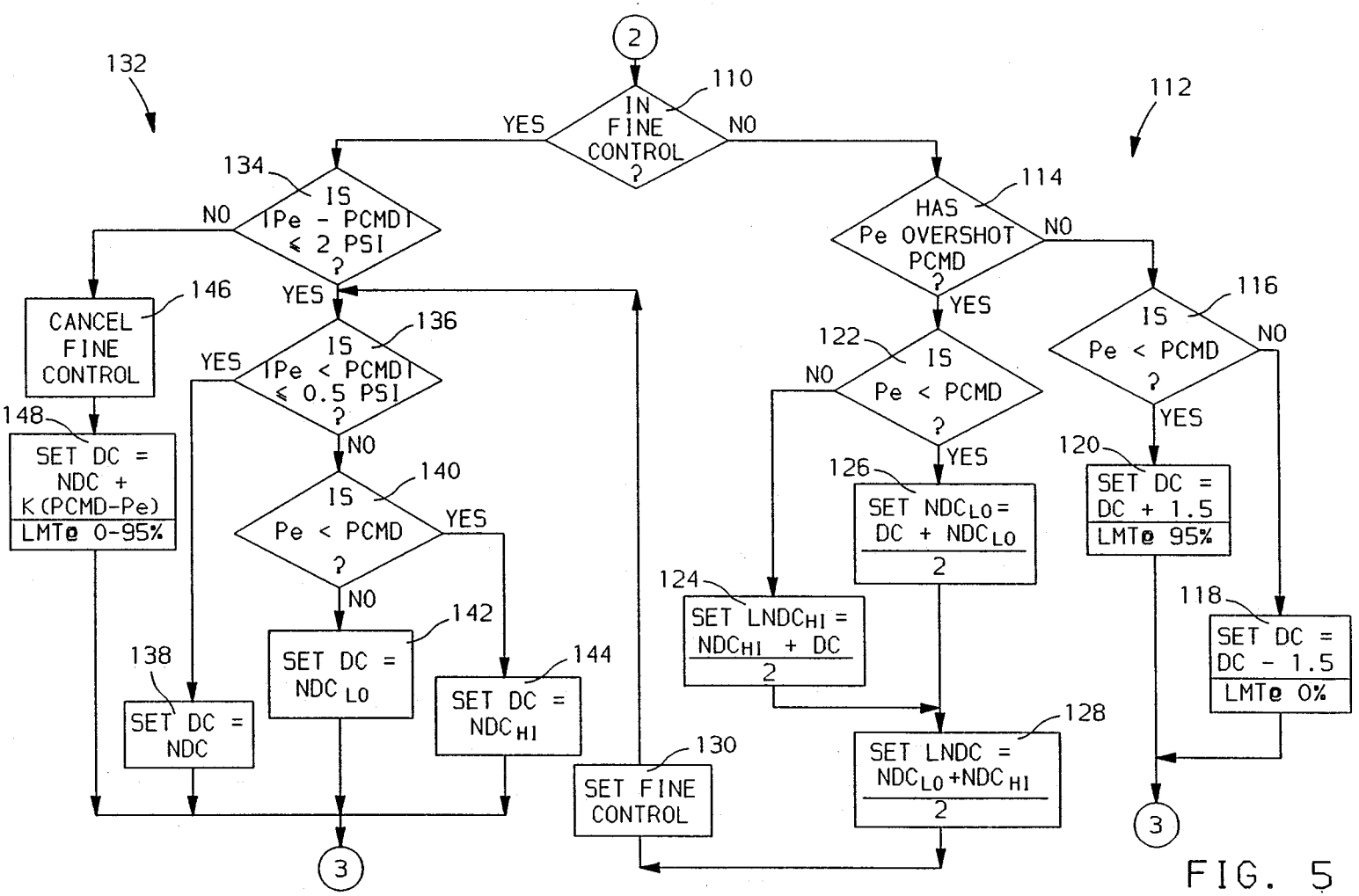
Figure 6:
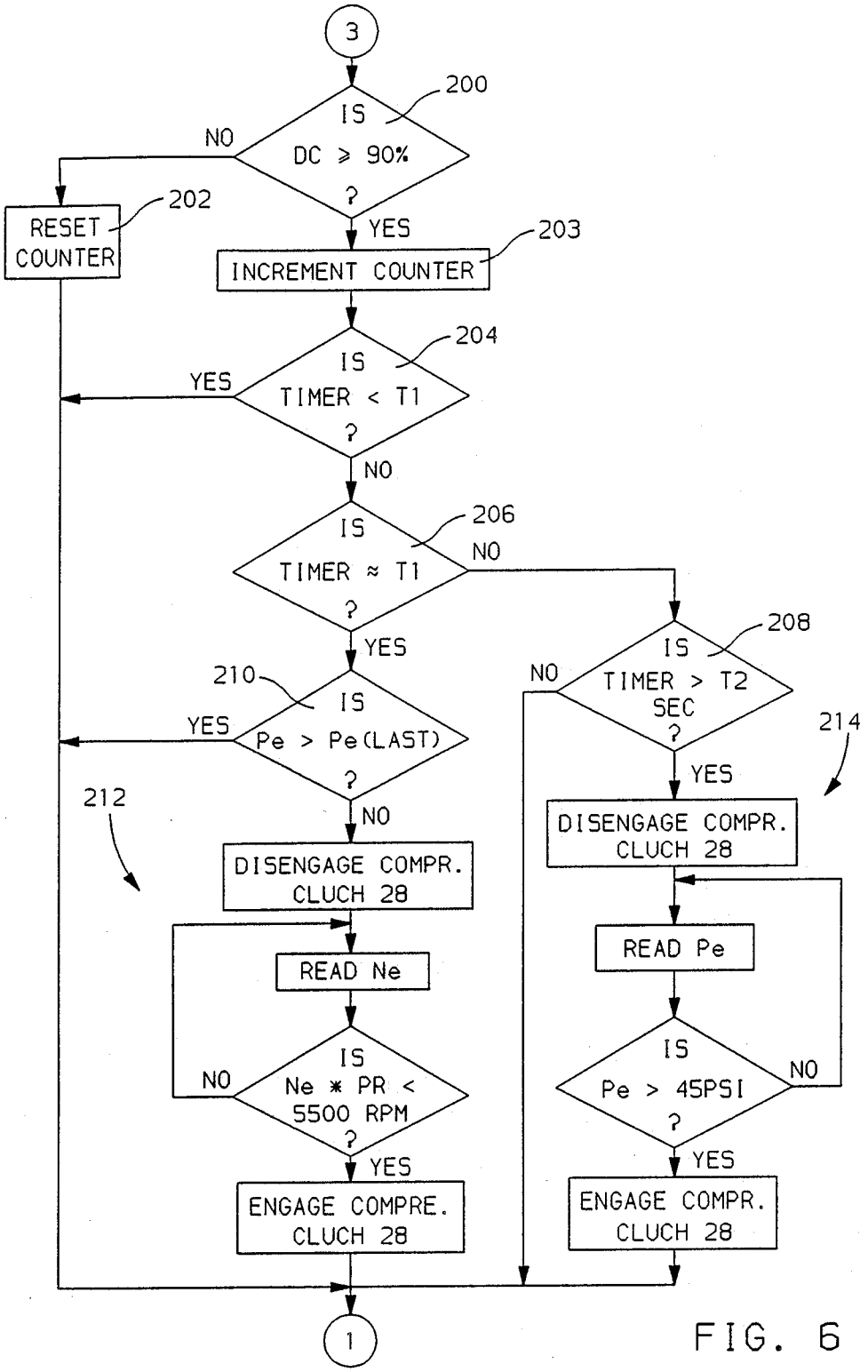

The flow diagrams of FIGS. 4–6 together represent a single loop program which is executed once every 100 milliseconds for determining the system pressure command and compressor duty cycle and for performing clutch disengage logic.

The flow diagram of FIG. 4 includes initialization and the determination of the system pressure command, PCMD. The reference numeral 80 generally designates a series of instructions executed at the initiation of each period of vehicle operation for initializing various timers, flags and program variables of the control unit 30. In the illustrated embodiment, for example, the compressor duty cycle DC is set to 0%, the compressor clutch 28 is engaged, a LOOP COUNTER is reset, and various parameters are initialized to nominal values.

Following initialization, the instruction blocks 82–84 are executed to read the various input values and to determine the value of the first pressure command PCMDl as a function of MODE and compressor speed ($N_e$*PR) as described above in reference to FIG. 2. Then the instruction block 86 is executed to compute a term DELTA corresponding to the acceleration of the engine 22 according to the expression:

$$, \text{DELTA} = N_e - N_e(\text{LAST})$$

where $N_e$(LAST) is the engine speed determined at a previous execution of the instruction block 82.

If the engine acceleration is positive, as determined at decision block 88, the flow diagram portion designated generally by the reference numeral 90 is executed to determine a compressor speed forecast and a corresponding second pressure command PCMD2, and to set the final pressure command equal to the greater of the first and second pressure commands. The forecasted compressor speed CRPM′ is determined at block 92 according to the expression:

$$\text{CRPM}' = \text{CRPM}(t) = \text{PR}\,(t^{*}\text{DELTA} + N_e)$$

where t is the time nominally required to destroke the compressor 12. The second pressure command PCMD2 is determined at block 94 as a function of MODE and CRPM′, using the table of FIG. 2. If the second pressure command PCMD2 is greater than the first pressure command PCMDl, as determined at decision block 96, the command term PCMD is set equal to PCMD2 at block 98. Otherwise, the command term PCMD is set equal to PCMDl at block 100. If the engine acceleration is not positive, as determined at decision block 88, only the block 100 of flow diagram portion 90 is executed to set the command term PCMD equal to the first pressure command PCMDl.

Once the pressure command term PCMD is determined, the flow diagram of FIG. 5 is executed as indicated by the circled numeral 2 to determine a duty cycle command for application to the PWM driver 58. In the mechanization of FIG. 1, the duty cycle applied to transducer 26 is inversely related to the resultant change in compressor displacement. That is, relatively high duty cycle energization of the transducer 26 serves to decrease the capacity of, or destroke, the compressor 12, while relatively low duty cycle energization serves to increase the capacity of the compressor 12. Intermediate duty cycle energization in the range of approximately 50%–70%, referred to herein as the nominal duty cycle range or NDC maintains the current capacity.

The flow diagram of FIG. 5 is also directed to a coarse./fine control for stabilizing the compressor capacity control and for adaptively defining the intermediate range of duty cycles which maintain the current compressor capacity. Referring to FIG. 5, the decision block 110 is first executed to determine if the FINE control mode is in effect. Initially, the FINE control mode is not in effect, and the flow diagram portion designated generally by the reference numeral 112 is executed to relatively quickly adjust the compressor duty cycle to a value which will bring the actual evaporator pressure into correspondence with the commanded value. If the actual value has not yet overshot the commanded value, as determined at decision block 114, the blocks 116–120 are executed to adjust the duty cycle at a rate of approximately 1.5% per loop, or 15% per second, limited by 0% on the lower end of the range and 95% on the upper end of the range.

Once the actual value overshoots (or undershoots) the commanded value, the decision block 114 is answered in the affirmative, and the blocks 122–126 are executed to adjust the value of the nominal duty cycle NDC. As indicated above, the term NDC represents the duty cycle which will maintain the compressor capacity at its current setting. In practice, there are a range of duty cycles which will satisfy this criteria, such range being defined herein by its upper and lower limits $NDC_{HI}$ and $NDC_{LO}$.

If the evaporator pressure has overshot the commanded value, as determined at decision block 122, the block 124 is executed to adjust the value of the upper limit $NDC_{HI}$ according to the expression:

$$NDC_{HI}=(NDC_{HI}+DC)/2$$

If the evaporator pressure has undershot the commanded value, the block 126 is executed to adjust the value of the lower limit $NDC_{LO}$ according to the expression:

$$NDC_{LO}=(NDC_{LO}+DC)/2$$

In each case, the term DC represents the duty cycle determined by the blocks 116–120; the duty cycle required to correct the evaporator pressure error. Once the respective nominal duty cycle limit has been updated, the adjustment is completed by instruction block 128 which revises the nominal duty cycle according to the expression:

$$NDC=(NDC_{LO}+NDC_{HI})/2$$

Then, the instruction block 130 is executed to set the FINE CONTROL mode, and the microcomputer 54 is directed to execute the FINE CONTROL portion of the routine as described below.

On the next execution of the control loop, the decision block 110 is answered in the affirmative, and the flow diagram portion designated generally by the reference numeral 132 is executed to make relatively fine adjustments of the duty cycle DC. If the evaporator pressure error $|P_e-PCMD|$ is 0.5 PSI or less, as determined by the decision blocks 134–136, the block 138 is executed to set the duty cycle DC equal to the nominal duty cycle value NDC to maintain the current compressor capacity. If the evaporator pressure error $|P_e-PCMD|$ is between 0.5 PSI and 2.0 PSI, the blocks 140–142 are executed to set the duty cycle at either $NDC_{LO}$ or $NDC_{HI}$, depending on whether $P_e$ is greater than or less than the pressure command PCMD. However, if the pressure error $|P_e-PCMD|$ is 2 PSI or greater, the blocks 146–148 are executed to cancel the FINE CONTROL mode, and to revise the duty cycle DC according to the expression:

$$DC=NDC+K(PCMD-P_e)$$

where K is a gain constant, and the resulting duty cycle value is limited to 95% on the upper end and 0% on the lower end.

Referring to the flow diagram of FIG. 6, the decision block 200 is first executed to determine if the commanded duty cycle DC is greater than a relatively high reference such as 90%. If not, the block 202 is executed to reset the LOOP COUNTER, completing the routine and returning the microcomputer 54 to block 82 of FIG. 4. If decision block 200 is answered in the affirmative, the LOOP COUNTER is incremented by block 203, and one or more of the decision blocks 204–208 are executed to compare the LOOP COUNTER value to a pair of reference intervals, designated T1 and T2.

If the LOOP COUNTER is less than T1, which may represent a relatively low value such as three seconds, the condition is assumed to be normal and the remainder of the routine is skipped. When the LOOP COUNTER value is one count more than three seconds (3.1 seconds), the decision block 210 is executed to determine if the current evaporator pressure $P_e$ is greater than a previously determined evaporator pressure value $P_e$(-LAST). If so, the compressor 12 is destroking, and the remainder of the routine is skipped. If not, the compressor is not destroking, and the flow diagram portion designated generally by the reference numeral 212 is executed to disengage the compressor clutch 28 until the compressor speed falls below a relatively high reference speed such as 5500 RPM.

If the compressor duty cycle stays above 90% for a relatively long time, such as 120 seconds, as determined by the decision block 208, the destroke is proceeding too slowly to ensure safe compressor operation. In such case, the flow diagram portion designated generally by the reference numeral 214 is executed to disengage the compressor clutch 28 until the evaporator pressure $P_e$ rises above a relatively high reference pressure such as 45 PSI.

Figure 3A:
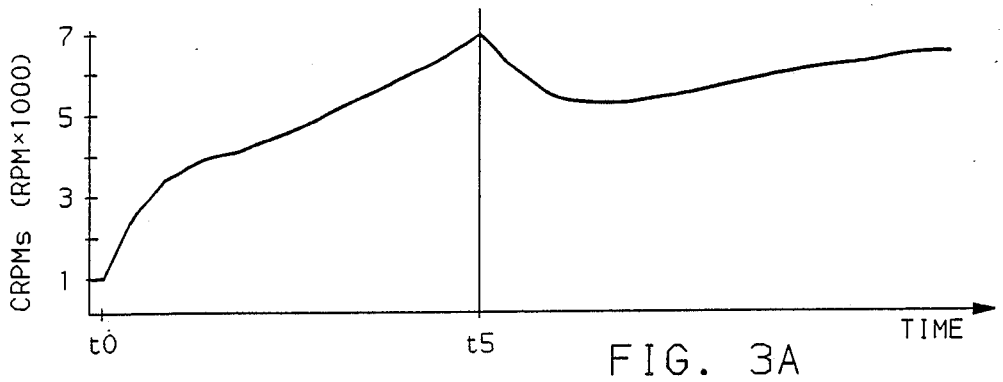
FIGS. 3A–3D are graphs depicting the operation of this invention in a period of vehicle operation involving idling, fast acceleration and moderate acceleration.
Figure 3B:
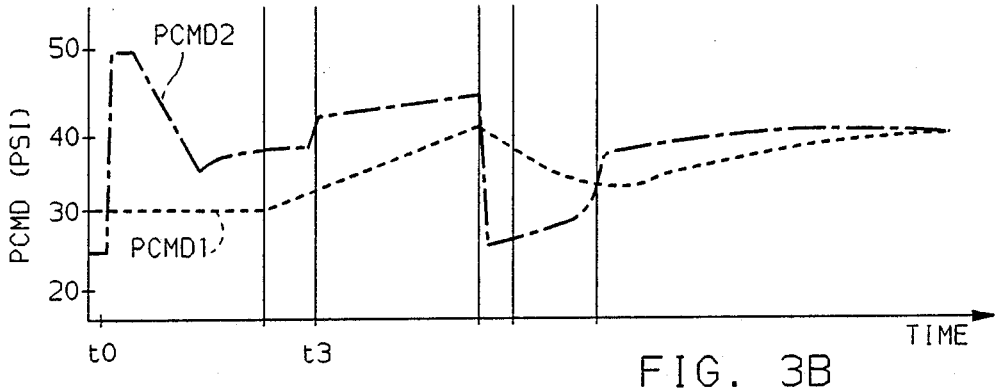
Figure 3C:
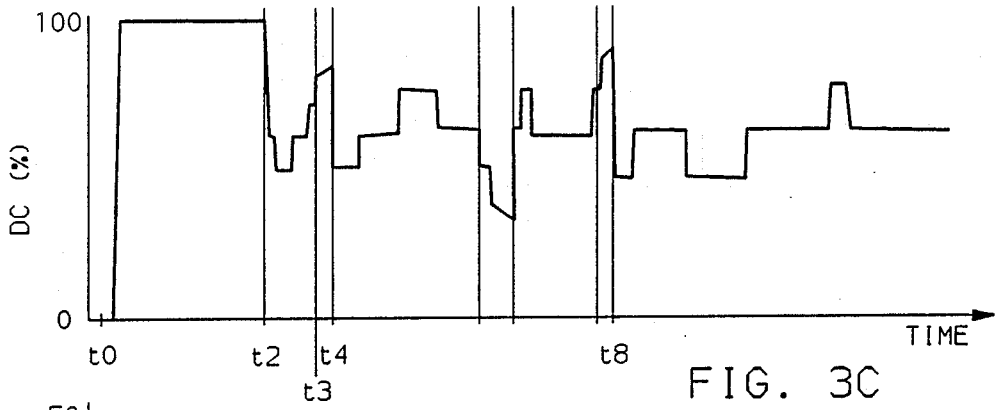
Figure 3D:
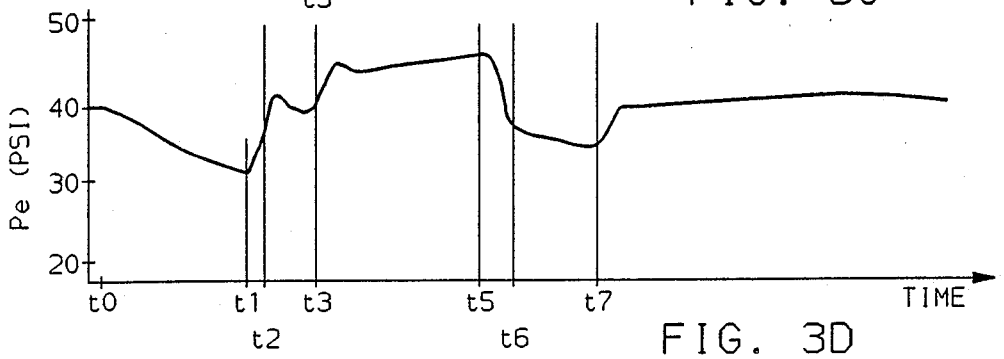

The graphs of FIGS. 3A–3D depict the operation of the controller and air conditioning system of FIG. 1 in a typical period of vehicle operation in which the vehicle is initially idling and then accelerates to a relatively steady speed. FIGS. 3A–3D are depicted on a common time base; FIG. 3A depicts the compressor speed CRPM, FIG. 3B depicts the first and second pressure commands PCMDl, PCMD2, FIG. 3C depicts the duty cycle output DC of controller 30, and FIG. 3D depicts the actual evaporator outlet pressure $P_e$. The normal mode of control head 48 is assumed.

Time $t_0$ represents the transition between engine idle and engine acceleration. Prior to the acceleration, the compressor speed CRPM is relatively low (1000 RPM), and the evaporator outlet pressure $P_e$ is relatively high (40 PSI) even though the compressor is operating at maximum capacity (0% DC). In such case, there is a significant error between the actual and commanded pressures $P_e$ and PCMDl, and the FINE CONTROL mode is not in effect.

In the first program loop after time $t_0$, however, the engine acceleration term DELTA becomes positive, and the pressure command PCMD is set equal to the second pressure command PCMD2 based on the forecasted compressor speed CRPM'. Since the actual pressure $P_e$ has now effectively undershot the commanded pressure PCMD2, the lower limit of the nominal duty cycle NDC is updated (block 126) and the duty cycle DC is set to $NDC_{HI}$ (block 144) to begin destroking the compressor. At this point, the engine acceleration term DELTA is still indicative of a potential overspeed condition, and in the next program loop, the duty cycle DC is raised to the 95% limit due to the $|P_e - PCMD|$ error (block 148).

The destroking initiated shortly after time $t_0$ continues for approximately 2 seconds before the evaporator pressure $P_e$ begins to increase at time $t_1$. At time $t_2$, however, the evaporator pressure $P_e$ overshoots the commanded pressure PCMD2. At this point, the upper limit of the nominal duty cycle $NDC_{HI}$ is updated (block 124) and the duty cycle DC is set to NDC (block 138). In successive executions of the program loop, the pressure error varies between zero and 2 PSI, causing the duty cycle to alternate between $NDC_{LO}$ (block 142), NDC (block 138) and $NDC_{HI}$ (block 144). This exemplifies the FINE CONTROL mode—pressure errors of 0.5 PSI or less produce no adjustment of the compressor capacity, and pressure errors of 0.5–2.0 PSI produce nominal predefined capacity adjustments.

The FINE CONTROL described above continues until time $t_3$ when an increase in the engine acceleration term DELTA produces a pressure error of greater than 2.0 PSI. At this point, FINE CONTROL is canceled (block 146), and the duty cycle DC is increased to an error-dependent value (block 148). Until the compressor adequately responds and the actual evaporator pressure $P_e$ undershoots the pressure command at time $t_4$, the duty cycle DC is steadily increased at a rate of 1.5% per program loop (block 120). At time $t_4$, FINE CONTROL is resumed as described above. Thus, the upper limit of the nominal duty cycle $NDC_{HI}$ is adjusted (block 124) and the duty cycle DC is revised based on the pressure error (blocks 136–144).

Another disturbance occurs at time $t_5$ when a transmission ratio upshift reverses the sign of the engine acceleration term DELTA. At such point, pressure command PCMD is set equal to the PCMD1 (block 100), resulting in a pressure command change, and therefore a pressure overshoot error of approximately 4 PSI. This initiates another cancellation of FINE CONTROL (block 146) and a downward revision of the duty cycle DC (blocks 148 and 118). An undershoot of the commanded pressure PCMD occurs at time $t_6$, and FINE CONTROL is resumed as described above. In this case, the lower limit of the nominal duty cycle $NDC_{LO}$ is adjusted (block 126) and the duty cycle DC is revised based on the pressure error (blocks 136–144).

A further disturbance occurs at time $t_7$ when the engine begins to accelerate after the ratio shift, and the pressure command is set equal to the second command based on the forecasted compressor speed CRPM' (block 98). A pressure error of greater than 2.0 PSI results, initiating another cancellation of FINE CONTROL (block 146) and an upward revision of the duty cycle DC (blocks 148 and 120). An overshoot of the commanded pressure PCMD occurs at time $t_8$, and FINE CONTROL is resumed as described above. In this case, the upper limit of the nominal duty cycle $NDC_{HI}$ is adjusted (block 124) and the duty cycle DC is revised based on the pressure error (blocks 136–144).

In the manner described above, the control of this invention protects an engine-driven variable displacement compressor from overspeed damage by destroking when the onset of an overspeed condition is anticipated. As soon as conditions no longer warrant destroking, the normal control is resumed so that the air conditioning performance is not unduly compromised.

While this invention has been described in reference to the illustrated embodiment, it will be understood that its application is broader than the specifically described system. Furthermore, it is expected that various modifications will occur to those skilled in the art, and that systems incorporating such modifications may fall within the scope of this invention, which is defined by the appended claims.

The embodiments of the invention in which an exclusive property or privilege is claimed are defined as follows:

1. In an automotive air conditioning system including an engine driven refrigerant compressor having a capacity determined in accordance with a control signal applied thereto, the compressor being subject to overspeed damage when operated at a relatively high capacity, a method of operation comprising the steps of:

generating a primary system command in relation to the current speed of the compressor;

periodically computing a forecasted speed value corresponding to a compressor speed which is expected to occur a predetermined time in the future, based on the current speed and acceleration of the compressor, and generating a secondary system command in relation therewith, at least when said current acceleration is indicative of positive acceleration; and comparing the primary and secondary system commands, and generating the compressor capacity control signal in relation to the system command which will result in the lower compressor capacity, thereby to override the compressor to a lower than normal capacity when overspeeding of the compressor is anticipated.

2. The method of operation set forth in claim 1, wherein:

the predetermined time used to compute the forecasted compressor speed value is the time nominally required to bring about a substantially minimum capacity condition of said compressor.

3. In an automotive air conditioning system including an engine driven refrigerant compressor having a displacement which is determined by the value of a displacement control signal applied thereto, the compressor being subject to overspeed damage when operated at relatively high displacement, a method of operation comprising the steps of:

measuring current speed and acceleration values corresponding to the current speed and acceleration of the compressor;

generating a primary system command in relation to the current speed value;

periodically computing a forecasted speed value corresponding to a compressor speed which is expected to occur a predetermined time in the future, based on the current speed and acceleration of the compressor, and generating a secondary system command in relation therewith, at least when said current acceleration is indicative of positive acceleration; and comparing the primary and secondary system commands, and generating the displacement control signal in relation to the system command which will result in the lower compressor displacement, thereby to override the compressor to a lower than normal displacement when a condition of compressor acceleration is detected.

4. The method of operation set forth in claim 3, wherein:

the predetermined time used to compute the forecasted compressor speed value is the time nominally required to bring about a substantially minimum displacement condition of said compressor.

5. In an automotive air conditioning system including an engine driven refrigerant compressor having a displacement which is determined by the value of a displacement control signal applied thereto, the compressor being subject to overspeed damage when operated at a relatively high displacement, and control apparatus for generating a displacement control signal for said compressor in relation to a system pressure command, a method of operation comprising the steps of:

measuring current speed and acceleration values corresponding to the current speed and acceleration of the compressor;

periodically computing a forecasted speed value corresponding to a compressor speed which is expected to occur a predetermined time in the future, based on the current speed and acceleration of the compressor, at least when said current acceleration is indicative of positive acceleration; and normally generating the system pressure command in relation to a compressor speed value, the pressure command generally increasing with increasing compressor speed, at least for relatively high speed values;

replacing the normally generated system command with an override system command determined in relation to the forecasted speed value whenever the forecasted speed value exceeds the current speed value.

6. The method of operation set forth in claim 5, wherein:

the predetermined time used to compute the forecasted compressor speed value is the time nominally required to bring about a substantially minimum displacement condition of said compressor.

7. In an automotive air conditioning system in which a system pressure is regulated through selective stroking and destroking of an engine driven refrigerant compressor to respectively increase and decrease the compressor displacement, and in which the compressor is subject to overspeed damage when not destroked, a method of operation comprising the steps of:

measuring current speed and acceleration values corresponding to the current speed and acceleration of the compressor;

normally generating the system pressure command in relation to a compressor speed value, the pressure command generally increasing with increasing compressor speed, at least for relatively high speed values;

periodically computing a forecasted speed value corresponding to a compressor speed which is expected to occur a predetermined time in the future, based on the current speed and acceleration of the compressor, at least when said current acceleration is indicative of positive acceleration; and replacing the normally generated system command with an override system command determined in relation to the forecasted speed value whenever override system command would destroke the compressor more than the normally generated system command.

8. The method of operation set forth in claim 7, wherein:

the predetermined time used to compute the forecasted compressor speed value is the time nominally required to substantially fully destroke the compressor.

* * * * *